US006142125A

United States Patent [19]

Shimayama et al.

[11] Patent Number: 6,142,125

[45] Date of Patent: Nov. 7, 2000

[54] SUPPLY PUMP FOR COMMON RAIL FUEL INJECTION SYSTEM

[75] Inventors: Yoshiro Shimayama; Haruyo Kimura, both of Fujisawa, Japan

[73] Assignee: Isuzu Motors Limited, Tokyo, Japan

[21] Appl. No.: 09/136,078

[22] Filed: Aug. 18, 1998

[30] Foreign Application Priority Data

Aug. 22, 1997 [JP] Japan ..... 9-226448
Aug. 22, 1997 [JP] Japan ..... 9-226449

[51] Int. Cl.[7] ..... F02M 37/04

[52] U.S. Cl. ..... 123/501; 123/450

[58] Field of Search ..... 123/501, 500, 123/450, 495, 504; 417/462

[56] References Cited

U.S. PATENT DOCUMENTS

| | | | |
|---|---|---|---|
| 4,944,275 | 7/1990 | Perr | 123/501 |
| 5,285,758 | 2/1994 | Fiedler | 123/495 |
| 5,307,781 | 5/1994 | Nakada | 123/495 |
| 5,404,855 | 4/1995 | Yen | 123/495 |
| 5,558,066 | 9/1996 | Zhao | 123/495 |
| 5,697,343 | 12/1997 | Isozumi et al. . | |
| 5,713,335 | 2/1998 | Perr | 123/501 |
| 5,860,406 | 1/1999 | Schmidt | 123/501 |

FOREIGN PATENT DOCUMENTS

| | | |
|---|---|---|
| 0 262 539 | 4/1988 | European Pat. Off. . |
| 0 507 191 | 10/1992 | European Pat. Off. . |
| 0 849 438 | 6/1998 | European Pat. Off. . |
| 4-308355 | 10/1992 | Japan . |

*Primary Examiner*—Carl S. Miller
*Attorney, Agent, or Firm*—Rader, Fishman & Grauer PLLC

[57] ABSTRACT

A supply pump for a common rail fuel injection system applicable to a multi-cylinder engine, that exerts a smaller load on a drive power transmission mechanism connecting the engine to the supply pump. To this end, fuel delivery timing of the supply pump is optimized. The number of engine cylinders may be different from that of fuel delivery of the supply pump. A first fuel delivery end timing is 30°±5° after compression top dead center of #1 cylinder, and subsequent fuel delivery end timings come at constant intervals. The constant intervals are obtained by dividing 720° by the number of fuel delivery per two rotations of an engine crankshaft.

5 Claims, 6 Drawing Sheets

FUEL DELIVERY TIMING (PRIOR ART)
FUEL DELIVERY TIMING (PRESENT INVENTION)
ENGINE REVOLUTION SPEED
CYLINDER PRESSURE
HIGH
LOW
HIGH
LOW
#1BTDC4°
#3BTDC64°
#1ATDC30°
#3BTDC30°
#1cyl
#2cyl
#3cyl
#4cyl
#5cyl
#6cyl
#1cyl
0
120
240
360
480
600
720
CRANKSHAFT ANGLE( °)

FUEL DELIVERY TIMING (PRIOR ART)
FUEL DELIVERY TIMING (PRESENT INVENTION)
ENGINE REVOLUTION SPEED
HIGH
LOW
CYLINDER PRESSURE
HIGH
LOW
q
p
#1cyl
#2cyl
#3cyl
#4cyl
#5cyl
#6cyl
#1cyl
0
120
240
360
480
600
720
CRANKSHAFT ANGLE( °)

SUPPLY PUMP FOR COMMON RAIL FUEL INJECTION SYSTEM

BACKGROUND OF THE INVENTION

1. Field of the Invention

The present invention relates to a supply pump for a common rail type (accumulation type) fuel injection system used in a diesel engine having a plurality of cylinders.

2. Description of the Related Art

There is a demand for high pressure fuel injection, and common rail fuel injection systems are developed in recent years. A general idea of a common rail fuel injection system will be described in reference to FIG. 2 of the accompanying drawings. A conventional common rail fuel injection system 1 includes a supply pump 2, a common rail 3 and unit injectors 4. The supply pump 2 feeds a pressurized fuel to the common rail 3. The pressurized fuel is accumulated in the common rail 3 and injected to cylinders of an engine from the respective unit injectors 4. Timing and amount of fuel injection from the unit injectors 4 are controlled by ECU (not shown).

Referring to FIG. 2A, the supply pump 2 is operatively connected to a crankshaft 78 of the engine 86 via a power transmission mechanism 84 so that it is driven by the engine 86. A typical power transmission mechanism is a chain-and-sprocket mechanism, a belt-and-pulley mechanism or a gear train mechanism.

The supply pump 2 also has a valve for adjusting a flow rate of pressurized fuel, and ECU controls this valve such that a discharge pressure of the supply pump 2 becomes a desired common rail pressure.

The common rail pressure drops each time a fuel is injected to the cylinders of the engine 86. In order to maintain the common rail pressure to a particular value or range, a fuel delivery timing of the supply pump 2 is synchronized with a fuel injection timing of the unit injectors 4 in the conventional common rail fuel injection system 1. The fuel delivery from the supply pump 2 takes place each time the fuel injection to the engine 86 takes place. Such a fuel injection system is disclosed in, for example, Japanese Patent Application, Kokai No. 4-308355.

However, the common rail fuel injection system 1 is different from a general fuel injection system in that the fuel delivery does not directly influence the fuel injection. Thus, the supply pump 2 does not necessarily feed the pressurized fuel to the common rail 3 each time the fuel is injected to the engine 86.

For example, if the engine has six cylinders, the fuel injection takes place six times while a crankshaft rotates twice. Accordingly, the general supply pump 2 feeds the fuel six times while the crankshaft rotates twice, with the fuel feed timing being in synchronization with the fuel injection timing. However, if it is possible to maintain the common rail pressure to a substantially constant value and insure an appropriate fuel injection, the supply pump 2 does not have to feed the fuel six times.

In consideration of the foregoing, a supply pump may be designed not to feed the fuel to the common rail in synchronization with the fuel injection timing. Specifically, the number of fuel delivery to the common rail 3 from the supply pump 2 during two rotations of the engine crankshaft 78 may differ from the number of the cylinders of the engine 86. For instance, a supply pump originally designed for a four-cylinder engine may be used in a six-cylinder engine. If this combination is feasible, a manufacturing cost will be reduced since the same supply pump is applicable to both of the four- and six-cylinder engines.

However, an excessively large load acts on the drive power transmission mechanism 84 between the supply pump 2 and the engine 86 unless the fuel delivery timing is optimum. In other words, if the timing of fuel supply from the supply pump is not appropriate, a chain tension and the like become so large, and therefore the same supply pump is not usable in different engines.

SUMMARY OF THE INVENTION

One object of the present invention is to provide a supply pump for a common rail fuel injection system, that is able to optimize a fuel delivery timing and therefore reduce a load on a drive power transmission mechanism.

Another object of the present invention to provide a supply pump for a common rail fuel injection system, that is applicable to an engine, the number of cylinders of which engine is different from the number of fuel delivery per two rotations of a crankshaft.

According to one aspect of the present invention, there is provided a supply pump for a common rail fuel injection system, which is driven by a multi-cylinder engine via a power transmission mechanism to feed a pressurized fuel to a common rail from the supply pump, characterized in that the number of fuel delivery to the common rail from the supply pump per two rotations of a crankshaft of the engine is different from the number of cylinders of the engine, and the fuel delivery timing is determined such that a less load acts on the power transmission mechanism.

According to another aspect of the present invention, there is provided a supply pump for a common rail fuel injection system, which is driven by a multi-cylinder engine via a power transmission mechanism, characterized in that the number of fuel delivery to a common rail from the supply pump per two rotations of an engine crankshaft is different from the number of engine cylinders, and a reference fuel delivery end timing is set to 30°±5° after a compression top dead center of a reference cylinder in terms of crankshaft angle and subsequent fuel delivery end timings come at constant intervals. The constant intervals are determined by dividing 720° by the number of fuel delivery.

In one preferred example of the present invention, the number of fuel delivery is four and the number of engine cylinders is six. These six cylinders may be called #1 cylinder, #2 cylinder . . . and #6 cylinder from the above-mentioned "reference cylinder" in the order of compression. The first or reference fuel delivery end timing may be 30° after compression top dead center of #1 cylinder, the second fuel delivery end timing may be 30° before compression top dead center of #3 cylinder, the third fuel delivery end timing may be 30° after compression top dead center of #4 cylinder and the fourth fuel delivery end timing may be 30° before compression top dead center of #6 cylinder. The multi-cylinder engine may be a so-called V-6 engine. The drive power transmission mechanism may be a chain-and-sprocket mechanism.

The supply pump may include a pump shaft driven by the engine via the drive power transmission mechanism, a feed pump driven by the pump shaft, a plunger chamber for receiving a fuel from the feed pump and having a plurality of radiantly extending channels, a plurality of plungers slidably placed in the plurality of plunger chamber channels respectively such that they are biased in radially outward directions of the plunger chamber respectively by the fuel received in the plunger chamber, a cam surface formed on an inner surface of the pump shaft for surrounding the plunger chamber to restrict reciprocating movements of the plungers in radial directions of the plunger chamber, cam projections formed on the cam surface for forcing the plungers in radially inward directions of the plunger chamber upon rotations of the pump shaft to supply the fuel to the common rail from the plunger chamber, a fuel passage connecting the feed pump to the plunger chamber, and a flow rate control valve located in the fuel passage for regulating an amount of fuel to be introduced to the plunger chamber thereby controlling an amount of fuel to be supplied to the common rail.

The plunger chamber may have four channels extending radiantly like a "X" shape from a center of the plunger chamber, and four plungers may be received in these channels respectively. The supply pump may stop the fuel delivery when the plungers are moved to the most radially inward position. The fuel delivery timing may not be synchronous to the fuel injection timing.

According to still another aspect of the present invention, there is provided a supply pump for a common rail fuel injection system, which is driven by a multi-cylinder engine via a drive power transmission mechanism, characterized in that the number of engine cylinders is equal to a multiple of the number of fuel deliver per two rotations of engine crankshaft and an integer, and fuel delivery takes place while an engine revolution speed is dropping due to compression strokes of particular engine cylinders.

The engine revolution speed dropping range in terms of crankshaft angle may be between 60° before compression top dead center of a predetermined cylinder and 15° after the compression top dead center. The number of fuel delivery may be three, the integer may be two and the number of engine cylinders may be six. The fuel delivery start timing may be between 60° before compression top dead center of the predetermined cylinder and the compression top dead center, and the fuel delivery end timing may be between 15° before compression top dead center of the predetermined cylinder and 15° after the compression top dead center. The six cylinders of the engine may be called #1 cylinder, #2 cylinder . . . and #6 cylinder in the order of compression. The "predetermined cylinder" may be #1, #3 and #5 cylinders. The multi-cylinder engine may be a so-called V-6 engine. The drive power transmission mechanism may be a chain-and-sprocket mechanism.

The supply pump may include a pump casing, a pump shaft driven by the engine via the drive power transmission mechanism and rotatably supported in the pump casing, a feed pump driven by the pump shaft, a plunger chamber for receiving a fuel from the feed pump and having a plurality of channels extending radiantly from a center of the plunger chamber, a plurality of plungers slidably placed in the channels of the plunger chamber respectively such that they are biased in a radially outward direction of the plunger chamber by the fuel received in the plunger chamber, a means for restricting reciprocating movements of the plungers in a radial direction of the plunger chamber, a cam means for moving the plungers in a radially inward direction of the plunger chamber upon rotations of the pump shaft to supply the fuel to the common rail from the plunger chamber, a fuel passage connecting the feed pump to the plunger chamber, and a flow rate control valve located in the fuel passage for regulating an amount of fuel to be introduced to the plunger chamber thereby controlling an amount of fuel to be supplied to the common rail. The pump shaft may have a hollow portion to define an inner surface, and the restriction means may be this inner surface of the pump shaft that surrounds the plunger chamber. The cam means may be cam projections formed on the inner surface of the pump shaft for moving the plungers in a radially inward direction of the plunger chamber upon rotations of the pump shaft. The plunger chamber may have three channels extending radiantly in a "Y" shape from a center of the plunger chamber and three plungers may slidably be received in the three channels respectively. The supply pump may stop fuel delivery when the plungers move to the most radially inward position. The fuel delivery timings may be synchronous to fuel injection timings. The supply pump may start the fuel delivery between 120° before compression top dead center of a predetermined cylinder and the compression top dead center, and may terminate the fuel delivery between 15° before compression top dead center of the predetermined cylinder and 15° after the compression top dead center.

DETAILED DESCRIPTION OF THE INVENTION

Now, preferred embodiments of the present invention will be described in reference to the accompanying drawings.

First Embodiment

Figure 2:
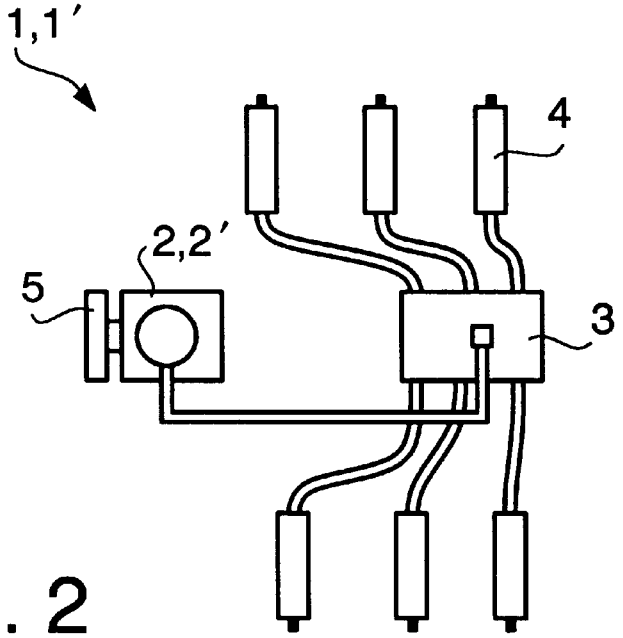
FIG. 2 illustrates a general structure of a common rail fuel injection system.
Figure 2A:
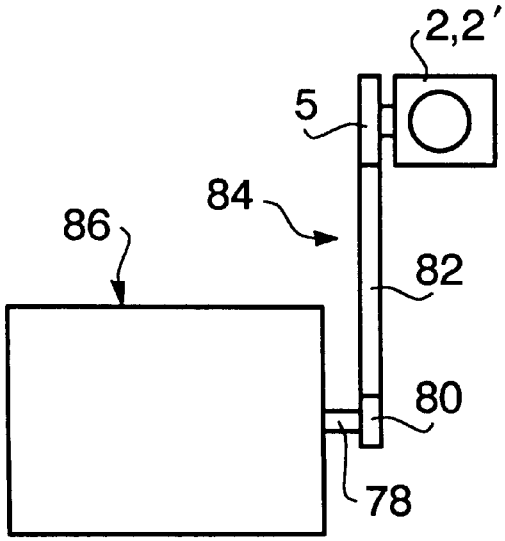
FIG. 2A illustrates a drive power transmission mechanism between an engine and a supply pump.

Referring to FIGS. 2 and 2A, a general construction of a common rail fuel injection system 1' of the first embodiment according to the present invention is the same as that described in the "Description of the Related Art" of this specification. The same or like reference numerals are used to designate the same or like components in the following description. The fuel injection system 1' includes a supply pump 2', a common rail 3 and six unit injectors 4. The supply pump 2' is driven by an engine 86 via a power transmission mechanism 84. In this particular embodiment, the power transmission mechanism 84 is a chain-and-sprocket mechanism and the engine 86 is a V-6 engine. The supply pump 2' and the unit injectors 4 are controlled by ECU (not shown). The chain-and-sprocket mechanism 84 includes a drive sprocket 80 attached to an engine crankshaft 78, a driven sprocket 5 attached to the supply pump 2' and a chain 82 engaged over these sprockets.

Figure 4:
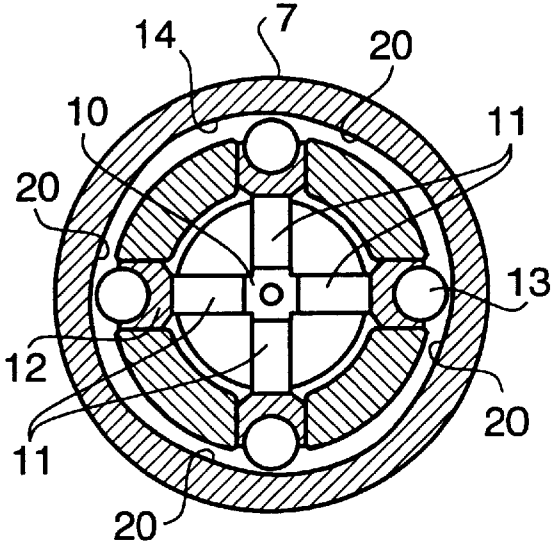
FIG. 4 is a front sectional view of the supply pump shown in FIG. 3.
Figure 3:
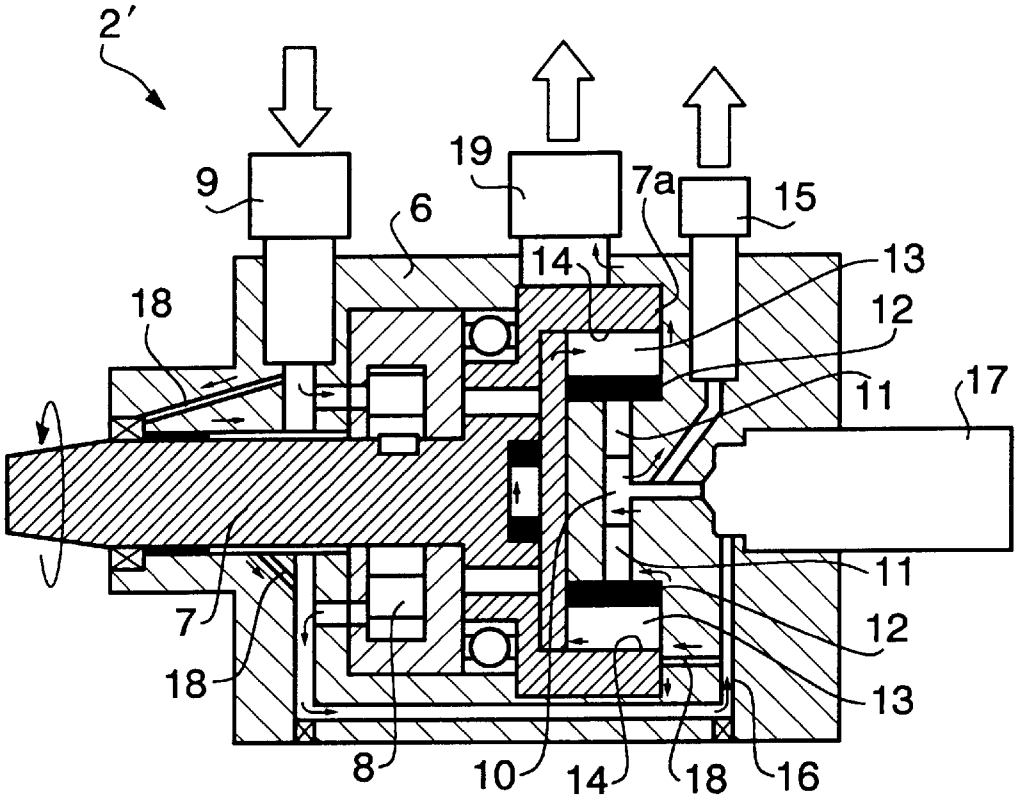
FIG. 3 illustrates an elevational side sectional view of the supply pump according to the first embodiment of the invention.

FIGS. 3 and 4 illustrate the detail of the supply pump 2'. This supply pump 2' is an inter cam type. Referring first to FIG. 3, the supply pump 2' has a pump casing 6 and a pump shaft 7 rotatably supported in the pump casing 6. The pump shaft 7 has the driven sprocket 5 (FIG. 2A) at this free end so that the pump shaft 7 is driven (rotated) by the engine 86 (FIG. 2A). As the pump shaft 7 is activated, a feed pump 8 is correspondingly activated. A fuel of gallery pressure is introduced to the feed pump 8 from an inlet nipple 9 (as indicated by the left downward unshaded arrow) and compressed therein upon rotations of the pump shaft 7. The compressed fuel is then supplied to a plunger chamber 10. As best illustrated in FIG. 4, the plunger chamber 10 has X-shaped four channels extending radiantly from a center of the plunger chamber, and four plungers 11 are slidably received in the plunger chamber channels respectively such that they are able to move in the predetermined radial directions. The four plungers 11 are biased in radially outward directions respectively by the pressure of fuel supplied to the plunger chamber 10 from the feed pump 8 to push associated shoes 12 and in turn rollers 13 against a cam surface 14 formed on an inner surface of a hollow enlarged diameter portion 7*a* of the pump shaft 7. The cam surface 14 rotates as the pump shaft 7 rotates, and the plungers 11 are caused to move reciprocally in the radial direction of the plunger chamber 10 upon rotations of the cam surface 14.

The four plungers 11 are moved simultaneously. When the plungers 11 are moved in the radially inward directions respectively (i.e., when the plungers 11 are lifted by the cam surface 14), the fuel in the plunger chamber 10 are pressurized and forced out of the plunger chamber 10. On the other hand, when the plungers 11 are moved in the radially outward directions, the fuel is introduced to the plunger chamber 10. When the fuel is forced out of the plunger chamber 10 under pressure, an outlet nipple 15 is used as a fuel exit as indicated by the right upward unshaded arrow of FIG. 3. On a fuel line 16 connecting between the feed pump 8 and the plunger chamber 10, provided is a fuel flow rate control valve 17. The valve 17 is controlled by ECU and adjusts an amount (or flow rate) of fuel allowed to enter the plunger chamber 10, thereby regulating the flow rate of fuel to be delivered from the plunger chamber 10. The pump casing 6 also has one or more lubrication passages 18. The fuel flows in these lubrication passages 18 to lubricate slidable components of the supply pump 2'. After that, the fuel returns to a fuel supply pipe from a leakage nipple 19.

The cam surface 14 has four projections 20 at 90-degree intervals as best illustrated in FIG. 4. Therefore, when the rollers 13 ride on the cam projections 20 respectively, the four plungers 11 are caused to move radially inward at the same time, thereby feeding the fuel to the common rail 3 (FIG. 2). Since the supply pump 2' rotates at a half of the speed of the engine crankshaft 78 (FIG. 2A), the shaft 7 of the supply pump 2' rotates once while the engine crankshaft 78 rotates twice, and the supply pump 2' delivers the fuel four times while the crankshaft 78 rotates twice. In the illustrated embodiment, therefore, the number of fuel delivery per two rotations of the crankshaft is four whereas the number of engine cylinders is six. In other words, the supply pump 2' originally designed for a four-cylinder engine is applied to the six-cylinder engine in this embodiment. It is the cam projections 20 that determine the fuel delivery timing of the supply pump 2', and the positions of the cam projections 20 are determined in the following manner.

Figures 1A, 1B, 1C, 1D:
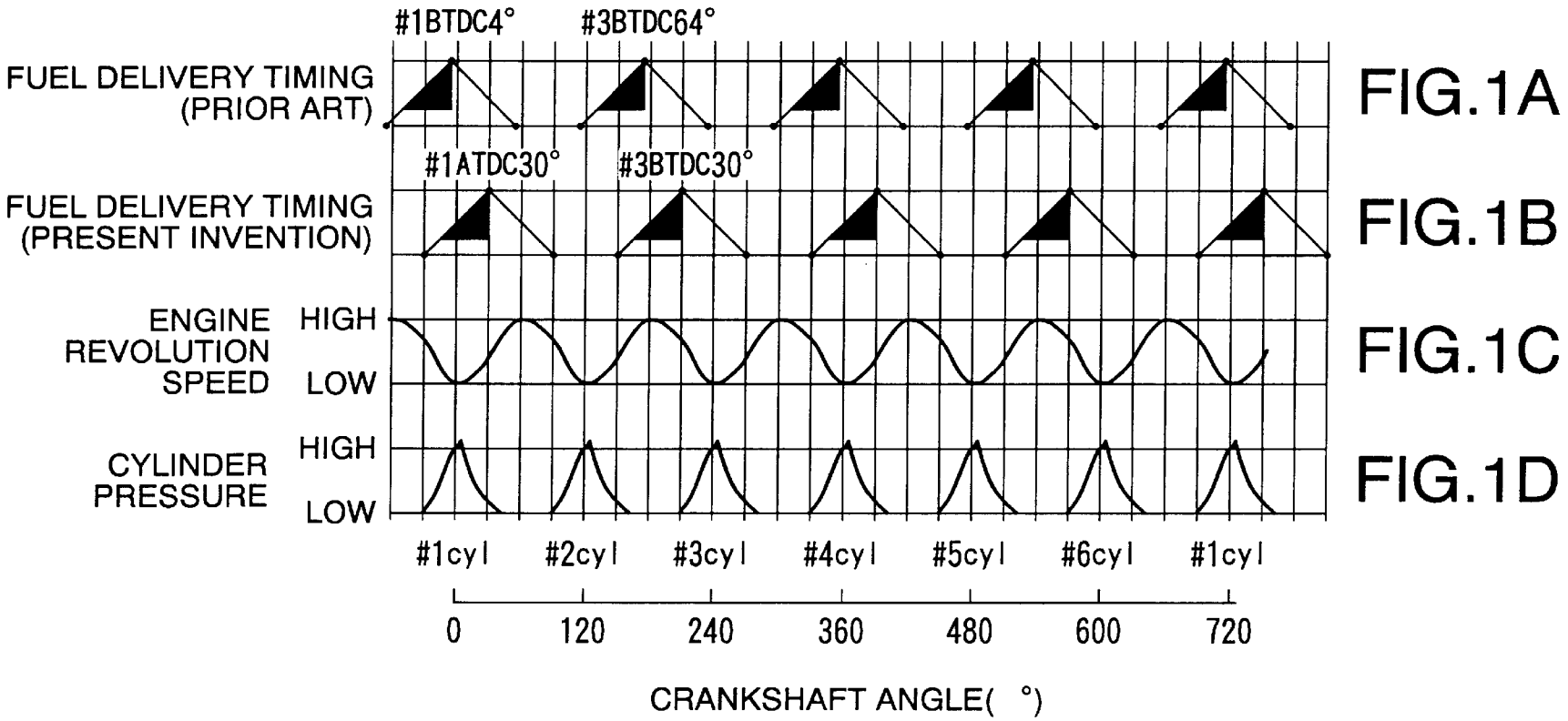
FIG. 1A is a graph showing a fuel delivery timing of a conventional supply pump.
FIG. 1B illustrates a fuel delivery timing chart according to a first embodiment of the present invention.
FIG. 1C illustrates a change of an engine revolution speed in connection with the fuel delivery timing of the supply pump.
FIG. 1D illustrates a change of engine cylinder pressure in connection with the engine revolution speed.

Referring now to FIGS. 1A to 1D, illustrated are relationship among the supply pump fuel delivery timing (FIGS. 1A and 1B), the engine rotational speed (FIG. 1C) and a cylinder inner pressure (FIG. 1D). Since the engine 86 is the six-cylinder engine, the cylinder pressure rises six times in a predetermined order at 120-degree intervals (720°/6=120°) in terms of crankshaft angle while the crankshaft 78 rotates twice. FIG. 1D shows this. In the engine 86, therefore, compression and expansion (combustion) take place six times per two rotations of the crankshaft 78. It should be noted in FIG. 1D that #1cyl, #2cyl . . . merely indicate the order of compression and they do not correspond to general cylinder numbers or names for the V-6 engine. In the illustrated embodiment, #1cyl is a reference cylinder and its compression top dead center is a reference crankshaft angle (0°). It is well known that the fuel injection takes place near a compression top dead center. In general, the engine revolution speed changes as the cylinder pressure rises and drops. Such engine revolution speed variation is depicted in FIG. 1C.

In FIGS. 1A and 1B, illustrated are fuel delivery timing charts according to the prior art and the present embodiment. The "Λ"-shaped solid line indicates lifting of the plungers 11 and the triangular shaded area indicates the fuel delivery time. As illustrated, the end of the fuel delivery corresponds to the maximum lift of the plungers 11, i.e., when the plungers 11 are at the most radially inward position. Since the supply pump 2' supplies the fuel four times while the crankshaft rotates twice, the fuel supply interval is 180° (720°/4=180°).

In the conventional supply pump, as shown in FIG. 1A, the first fuel delivery ends at 4° before a compression top dead center of the reference cylinder #1cyl (#1BTDC4°). Consequently, the next fuel delivery ends at 64° before the compression top dead center of #3cyl. The same thing repeats in the third and fourth fuel delivery; the third fuel delivery ends at 4° before the compression top dead center of #4cyl and the fourth fuel delivery ends at 64° before the compression top dead center of #6cyl . In this manner, the fuel delivery timing of the conventional supply pump is not synchronous to the fuel injection timing. However, such a conventional supply pump has a problem.

Figure 5:
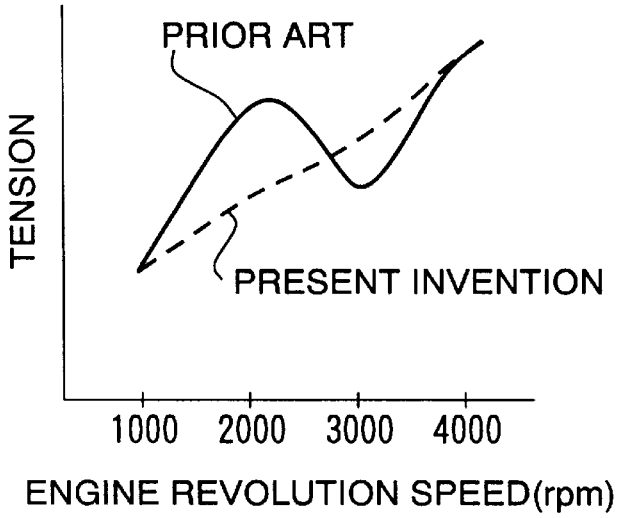
FIG. 5 is a graph schematically showing relationship between an engine revolution speed (rpm) and a chain tension of the drive power transmission mechanism.

Referring to FIG. 5, when the engine revolution speed is around 2,000 rpm, which is the most frequently used speed range, a peak load acts on the chain 82 (FIG. 2A) of the drive power transmission mechanism 84 as the solid line curve (prior art) indicates. This is not preferred because the chain load increases and decreases very frequently and sharply. If the large load acts on the chain 82 so often, longevity of the chain 82 and associated elements of the drive power transmission mechanism 84 is shortened, engagement between the chain 82 and sprockets 5 and 80 is degraded and noises are generated. If these drawbacks occur, the supply pump cannot practically be used for the engine.

Therefore, the inventors conducted experiments to find out optimum fuel delivery timing. FIG. 1B illustrates the result. As illustrated in this graph, the reference fuel delivery end timing corresponds to 30° after the compression top dead center of the reference cylinder (#1ATDC30°), and the next fuel delivery end timing is 180° after the first fuel delivery end, i.e., 30° before the compression top dead center of #3cyl (#3BTDC30°). Likewise, the third fuel delivery ends at 30° after the compression top dead center of #4cyl and the fourth fuel delivery ends at 30° before the compression top dead center of #6cyl. The fuel delivery timing is not synchronous to the fuel injection timing. It should be noted that the fuel delivery timing can easily be changed by changing the positions of the cam projections 20 of the supply pump 2' (FIG. 4).

Referring back to FIG. 5, the chain load according to the present invention (broken line) does not have a peak and simply increases in proportion to the engine revolution speed. This is a preferred tension curve. As a result, the total load on the drive power transmission mechanism 82 is reduced as compared with the conventional supply pump and therefore it is possible to use a supply pump originally designed for a four-cylinder engine in a six-cylinder engine.

Figure 6:
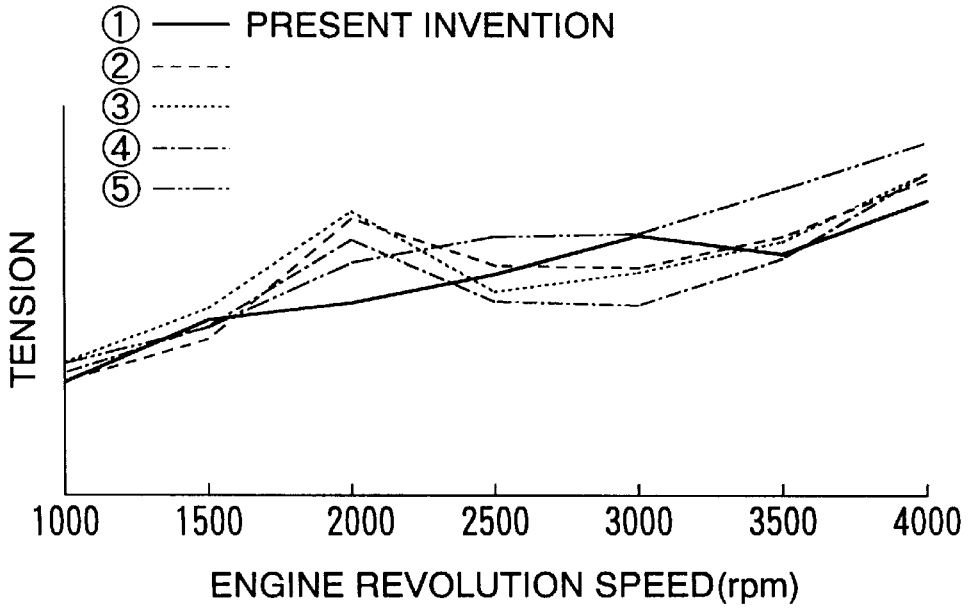
FIG. 6 illustrates the relationship between the engine revolution speed and the chain tension in detail according to experimental results.

FIG. 6 illustrates the detail of the experimental results. This drawing includes five lines (1) to (5), two of which correspond to FIGS. 1A and 1B. Specifically, the line (1) has the reference fuel delivery end at #1ATDC30° (present invention; FIG. 1B), the line (2) has the reference fuel delivery end at #1BTDC4° (prior art; FIG. 1A), the line (3) has a reference fuel delivery end at #1ATDC13°, the line (4) has a reference fuel delivery end at #1ATDC39° and the line (5) has a reference fuel delivery end at #1ATDC22°. The fuel delivery interval is 180° in the five lines (1) to (5). As seen in FIG. 6, the line (1) has the least tension fluctuation and the smallest tension in the most frequently used range (around 2,000 rpm ). According to the graph, it is confirmed that the line (1) of the present invention is most preferred. The lines (2) and (3) have a large tension around 2,000 rpm, the line (4) greatly changes in the 2,000 rpm area, and the line (5) has a large tension over the almost entire revolution range. Therefore, the lines (2)–(5) are not preferred.

In conclusion, the experiments revealed that the reference fuel delivery end timing of the supply pump 2' is preferably set to 30°±5° after the compression top dead center of the reference cylinder. The positions of the cam projections 20 are determined to meet this requirement.

It should be noted that the present invention is not limited to the described and illustrated embodiment. For example, the number of cylinders of the engine 86 is not limited to six, and the number of fuel delivery of the supply pump 2' is not limited to four. Further, the supply pump 2' is not limited to the inner cam type. For instance, it may be an in-line pump. Moreover, the drive power transmission mechanism 84 may be a belt-and-pulley mechanism or a gear train mechanism.

Second Embodiment

Referring to FIGS. 2 and 2A, a general structure of a common rail fuel injection system 1' of this embodiment is the same as the first embodiment. Therefore, the same reference numerals are used to indicate the same or similar components in the first and second embodiments. The fuel injection system 1' includes a supply pump 2', a common rail 3 and six unit injectors 4. The supply pump 2' has a sprocket 5, an engine 86 has a sprocket 80, and these sprockets are operatively connected by a chain 80. The sprockets 5 and 80 and the chain 80 define a drive power transmission mechanism 84 between the engine 86 and the supply pump 2'. The illustrated power transmission mechanism 84 is therefore a chain-and-sprocket mechanism. The supply pump 2' is driven by the engine 86 via the drive power transmission mechanism 84. The sprocket 5 is a driven sprocket and the sprocket 80 is a drive sprocket. The engine 86 is a V-6 engine and the supply pump 2' and unit injectors 4 are controlled by ECU (not shown).

Figure 9:
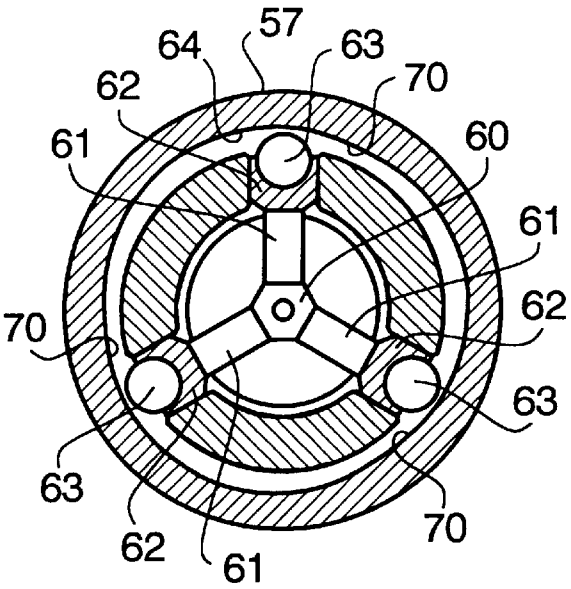
FIG. 9 is a front sectional view of the supply pump shown in FIG. 8.
Figure 8:
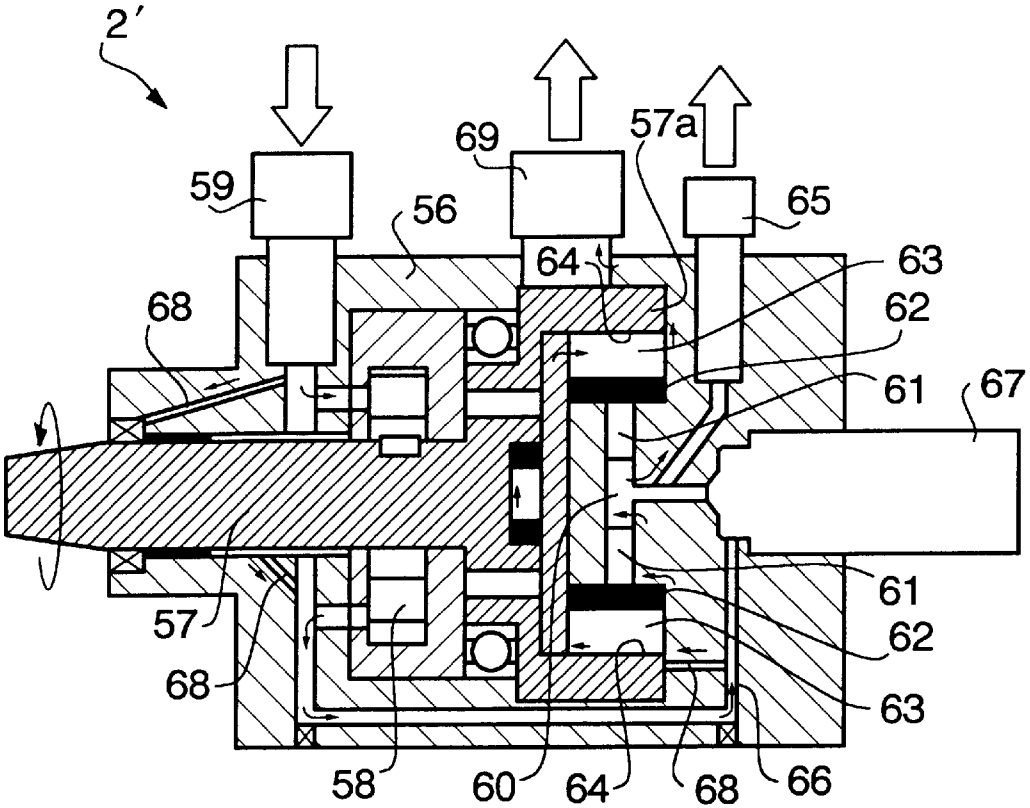
FIG. 8 is a side sectional view of the supply pump of the second embodiment.

Referring to FIGS. 8 and 9, illustrated is the detail of the supply pump 2' of the second embodiment. As shown in FIG. 8, this supply pump 2' is also the inner cam type. The supply pump 2' includes a pump casing 56 and a shaft 57 rotatably supported in the casing 56. The sprocket 5 (FIG. 2A) of the drive power transmission mechanism 84 is attached to a free end of the pump shaft 57. Thus, the pump shaft 57 is driven by the engine 86 via the drive power transmission mechanism 84. As the pump shaft 57 is rotated by the engine, a feed pump 58 is operated. The feed pump 58 compresses a fuel, which has been introduced from an inlet nipple 59 at a gallery pressure, and feeds it to a plunger chamber 60. As best seen in FIG. 9, the plunger chamber 60 has three Y-shaped radiantly extending channels. Three plungers 61 are slidably received in the three channels of the plunger chamber 60 respectively so that they are movable in the radial direction of the plunger chamber 60 respectively. The plungers 61 are biased radially outward by the pressure of fuel supplied from the feed pump 58 to force rollers 63 against a cam surface 64 via shoes 62. The cam surface 64 is formed on an inner periphery of an enlarged diameter portion 57*a* of the pump shaft 57. The cam surface 64 rotates upon rotations of the pump shaft 57, and the plungers 61 reciprocate in the plunger chamber channels in the radial directions of the plunger chamber upon rotations of the cam surface 64.

The three plungers 61 move simultaneously. When the plungers 61 move radially inward (i.e., when the plungers are lifted by the cam surface 64), the fuel in the plunger chamber 60 is compressed and forced out of the plunger chamber 60. When the plungers move radially outward, on the other hand, the fuel is introduced to the plunger chamber 60. An outlet nipple 65 (FIG. 8) is a fuel exit when the fuel is forced out of the plunger chamber 60. A flow rate control valve 67 is provided in a fuel line 66 connecting the feed pump 58 with the plunger chamber 60. The valve 67 operates under control of ECU and regulates an amount of fuel admitted to the plunger chamber 60 and adjusts an amount of fuel discharged from the plunger chamber 60. The pump casing 56 has lubrication passageways 68. The fuel which flows through the lubrication passageways 68 lubricates slidable components of the supply pump 2' and then returns to a fuel delivery pipe from a leakage nipple 69.

The cam surface 64 has three projections 70 as illustrated in FIG. 9. The projections 70 are spaced 120° from each other in the circumferential direction. Therefore, if the rollers 63 ride on the cam projections 70 respectively, the plungers 61 move radially inward (lifted) simultaneously to cause the fuel delivery. Since the supply pump 2' is rotated at a half speed of an engine crankshaft 78 (FIG. 2A), the pump shaft 57 of the supply pump 2' rotates once while the crankshaft 78 rotates twice. As a result, the supply pump 2' delivers the fuel to the common rail 3 (FIG. 2) three times while the crankshaft 78 rotates twice. Thus, the number of cylinders of the engine 86 (six) is a multiple of the number of fuel delivery per two rotations of the crankshaft (three) and an integer (two) in this embodiment. The fuel delivery timing of the supply pump 2' is determined by the cam projections 70. The positions of the cam projections 70 are determined as follows.

Figures 7A, 7B, 7C, 7D:
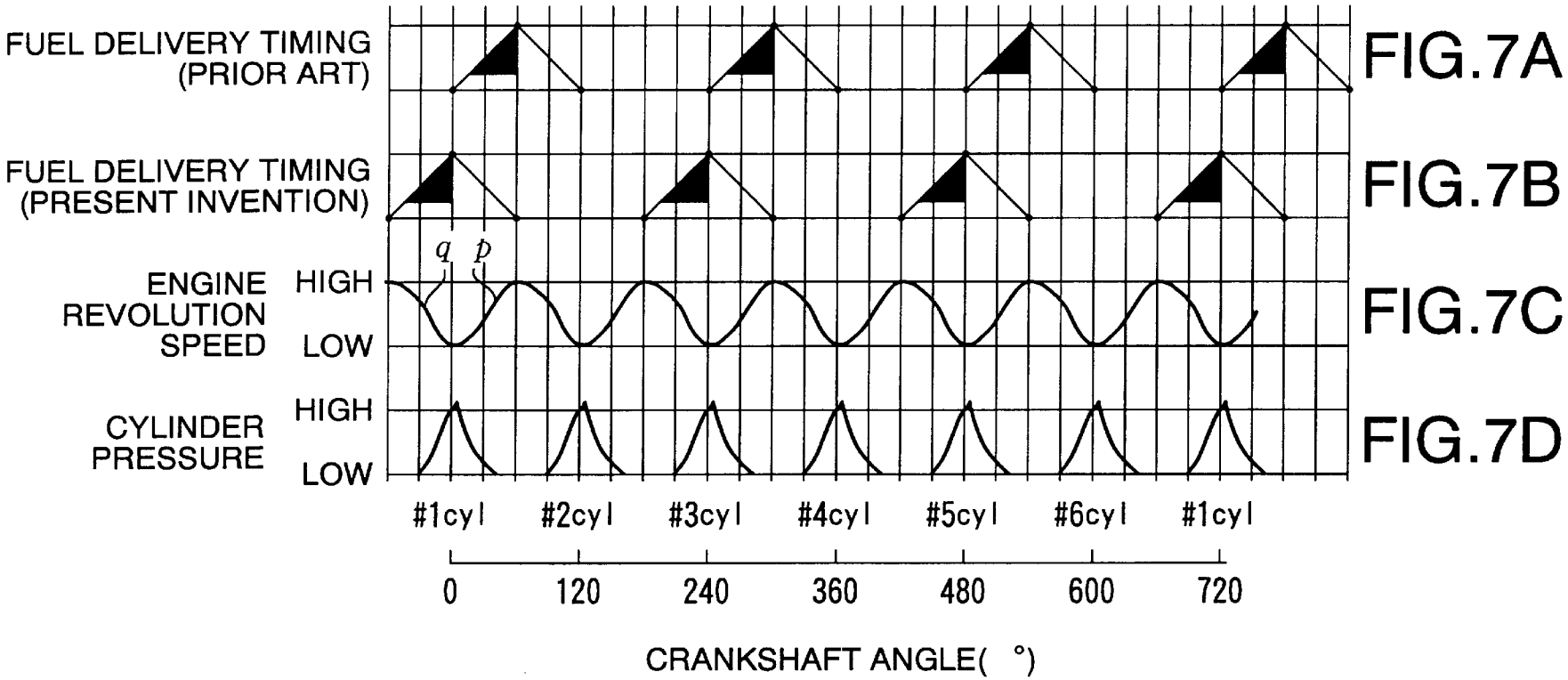
FIG. 7A illustrates a fuel delivery timing chart according to a conventional supply pump.
FIG. 7B illustrates a fuel delivery timing chart according to a second embodiment of the present invention.
FIG. 7C illustrates a change of an engine revolution speed in connection with the fuel delivery timing.
FIG. 7D illustrates a change of engine cylinder pressure in connection with the engine revolution speed.

Referring to FIGS. 7A to 7D, illustrated are relationship among fuel delivery timing of the conventional supply pump (FIG. 7A), that of the present invention (FIG. 7B), engine revolution speed (FIG. 7C) and cylinder pressure (FIG. 7D). Since the engine 86 (FIG. 2A) is a six-cylinder engine, the cylinder pressure rises in the predetermined order to perform compression and expansion (combustion) at 120° crankshaft angle intervals (720°/6=120°) as illustrated in FIG. 7D. In FIG. 7D, #1cyl, #2cyl . . . simply indicate the compression order of the six cylinders of the engine and do not indicate the general cylinder numbers of the V-6 engine. In the drawing, #1cyl is a reference cylinder and the compression top dead center of this cylinder is a reference crankshaft angle (0°). It is well known that the fuel injection takes place near the compression top dead center.

Referring to FIG. 7C, the engine revolution speed changes with the cylinder pressure. Specifically, when the cylinder pressure rises (i.e., compression), a compression force is applied to a piston in the cylinder so that the engine revolution speed drops. When the cylinder pressure decreases (i.e., expansion), the piston is forced downward by a combustion pressure so that the engine revolution speed increases.

Referring now to FIGS. 7A and 7B, the "Λ"-shaped solid line indicates a lift of the plungers 61 and the shaded area indicates the fuel delivery time. As understood from these drawings, the end of the fuel delivery corresponds to the maximum lift of the plungers 61, i.e., when the plungers 11 are at the most radially inward position. The supply pump 2' supplies the fuel at constant crankshaft angle intervals. Since the supply pump 2' supplies the fuel to the common rail three times while the crankshaft rotates twice, the fuel supply interval is 240° (720°/3=240°). The fuel delivery timing is synchronous to the fuel injection timing as appreciated from the drawings.

In the conventional supply pump, as shown in FIG. 7A, the fuel delivery (triangular shaded areas) takes place when every other cylinders (#1cyl, #3cyl and #5cyl) of the engine are in the expansion condition. In other words, the conventional supply pump feeds the fuel when the engine revolution speed is in an increment range "p" (FIG. 7C).

However, an excessive load applies to the drive power transmission mechanism 84 (FIG. 2A) if the conventional supply pump is employed. Specifically, the engine revolution speed rises on one hand but the pump shaft 57 (FIG. 8) intends to stop due to the plunger compression force on the other hand. Consequently, a large load acts on the drive power transmission mechanism and a chain tension increases. This is not preferred since longevity of the chain and associated parts is deteriorated and noises are generated from the power transmission mechanism.

In order to overcome these drawbacks, the fuel delivery takes place while the engine revolution speed is decreasing (range "q") in this embodiment as illustrated in FIG. 7B. If the fuel delivery is carried out in this manner, the pump shaft tends to stop when the engine revolution speed decreases. Therefore, a large load is not applied to the power drive mechanism and the chain tension does not become large. Consequently, the longevity of the drive power transmission mechanism is improved and noises during operation are reduced. In practice, it is preferred that the fuel delivery starting point is set between 60° before the compression top dead center (BTDC60°) of the cylinder and the compression top dead center, and the fuel delivery ending point is set between 15° before the compression top dead center of the cylinder and 15° after the compression top dead center (ATDC15°). It should be noted that the cylinder undergoes the expansion stroke after the compression top dead center, but increasing of the engine revolution speed is small and the chain tension does not become large in a certain range after the compression top dead center. Therefore, it is acceptable to set the fuel delivery end point after the compression top dead center or it is acceptable for the fuel delivery period to extend even after the compression top dead center. Therefore, the range "q" in FIG. 7C and the term "engine revolution speed deceasing range" may include a particular portion (engine revolution increasing portion) after the compression top dead center.

If the amount of fuel to be delivered from the supply pump 2' is insufficient, the fuel delivery start point may be shifted to the left in FIG. 7B (before 60° before the compression top dead center; 120° before the compression top dead center at most) to elongate the fuel delivery period and increase the amount of fuel delivery. The fuel delivery end point may not be changed. In this case, however, the fuel delivery period extends over both the engine revolution speed decreasing range "q" and increasing range "p" so that it is not the best. Even so, it is possible to prevent the chain tension from rising greatly if a second half of the fuel delivery period, in which the pump drive power or chain tension increases, stays in the engine revolution speed decreasing range "q" after 60° before the compression top dead center.

Results of experiments regarding this embodiment will be shown below. Experiment conditions were as follows: the engine revolution speed was 4,000 rpm, the common rail pressure was 120 MPa, and the fuel pump flow rate was 2.5 g/rpmlh. The fuel delivery end was set to ATDC77° in the convention supply pump, and the chain tension was measured 770 kgf. The fuel delivery end was set to ATDC9° in the supply pump 2' of the invention, and the chain tension was reduced to 420 kgf. It was also confirmed that the chain tension was reduced over the whole engine revolution speed range and the noises of the drive power transmission mechanism was reduced over the whole engine speed range.

It should be noted that the present invention is not limited to the described and illustrated embodiment. For example, the number of cylinders of the engine 86 is not limited to six but may be four, and the number of fuel delivery of the supply pump 2' per two rotations of the crankshaft may be two. Further, the supply pump 2' may be employed when the number of the engine cylinders is equal to the number of fuel delivery per two rotations of the crankshaft (e.g., six-cylinder engine and six-time fuel delivery supply pump, or four-cylinder engine and four-time fuel delivery supply pump). In this case, the number of fuel delivery per two rotations of the crankshaft is exactly the same as the number of engine cylinders. Moreover, the supply pump 2' is not limited to the inner cam type. For instance, it may be an in-line pump. The drive power transmission mechanism 84 may be a belt-and-pulley mechanism or a gear train mechanism.

The supply pump for the common rail fuel injection system is disclosed in Japanese Patent Application Nos. 9-226448 and 9-226449, both filed Aug. 22, 1997 and the entire disclosure thereof is incorporated herein by reference.

What is claimed is:

1. A supply pump for a common rail fuel injection system, which is driven by a multi-cylinder engine via a power transmission mechanism, characterized in that the number of fuel deliveries to a common rail from the supply pump per two rotations of an engine crankshaft is different from the number of engine cylinders, and a reference fuel delivery end timing is set to 30°±5° after a compression top dead center of a reference cylinder in terms of crankshaft angle and subsequent fuel delivery end timings come at constant intervals, which intervals are determined by dividing 720° by the number of fuel deliveries.

2. The supply pump of claim 1, wherein the number of fuel deliveries is four and the number of engine cylinders is six.

3. The supply pump of claim 2, wherein the six cylinders are called #1 cylinder, #2 cylinder, #3 cylinder, #4 cylinder, #5 cylinder and #6 cylinder from the reference cylinder in the order of compression, and the reference fuel delivery end timing is 30° after compression top dead center of #1 cylinder, the second fuel delivery end timing is 30° before compression top dead center of #3 cylinder, the third fuel delivery end timing is 30° after compression top dead center of #4 cylinder and the fourth fuel delivery end timing is 30° before compression top dead center of #6 cylinder.

4. The supply pump of claim 1, wherein the drive power transmission mechanism is a chain-and-sprocket mechanism.

5. The supply pump of claim 1, wherein the supply pump includes:

a pump shaft driven by the engine via the drive power transmission mechanism;

a feed pump driven by the pump shaft;

a plunger chamber for receiving a fuel from the feed pump, the plunger chamber having at least one channel extending in a radial direction of the plunger chamber;

at least one plunger slidably received in the channel of the plunger chamber such that it is biased in a radially outward direction of the plunger chamber by the fuel in the plunger chamber;

a cam surface formed on an inner surface of the pump shaft for surrounding the plunger chamber to restrict a reciprocating movement of the plunger in a radial direction of the plunger chamber;

projections formed on the cam surface for moving the plunger in a radially inward direction of the plunger chamber to supply the fuel toward the common rail from the plunger chamber;

a fuel passage connecting the feed pump to the plunger chamber; and a flow rate control valve located in the fuel passage for regulating an amount of fuel to be introduced to the plunger chamber thereby controlling an amount of fuel to be supplied to the common rail.

* * * * *